United States Patent [19]

Geiger

[11] Patent Number: 4,895,368

[45] Date of Patent: Jan. 23, 1990

[54] GOLF CLUB AND ASSEMBLY PROCESS

[76] Inventor: L. Michael Geiger, 156 Emmaus Rd., Poquoson, Va. 23662

[21] Appl. No.: 265,946

[22] Filed: Nov. 2, 1988

[51] Int. Cl.[4] ..... A63B 53/02

[52] U.S. Cl. ..... 273/80.1; 273/80.2; 273/80.8; 403/383

[58] Field of Search ..... 273/80 R, 80.1–80.9, 273/70, 67 A; 403/287, 383, 301, 286; 285/237, 330; 81/177.1, 177.8, 177.9, 489; 16/110 R, DIG. 41

[56] References Cited

U.S. PATENT DOCUMENTS

| | | | |
|---|---|---|---|
| 1,426,202 | 8/1922 | Lard | 273/80.2 |
| 1,524,590 | 1/1925 | Stanley | 43/18.1 |
| 1,831,255 | 11/1931 | Menzies | 273/80.8 |
| 1,930,204 | 10/1933 | Judd et al. | 273/80.4 |
| 1,946,134 | 2/1934 | Dyce | 273/80 R |
| 2,203,893 | 6/1940 | Chapman | 273/80.8 |
| 2,299,735 | 10/1942 | Birkhofer | 273/80.8 |
| 3,825,991 | 7/1974 | Cornell | 273/80.2 |
| 3,848,737 | 11/1974 | Kenon | 273/80.1 |
| 4,206,821 | 6/1980 | Emmerich | 175/321 |
| 4,253,666 | 3/1978 | Murphy | 273/80.1 |
| 4,470,600 | 9/1984 | Parente et al. | 273/80.8 |
| 4,597,577 | 7/1986 | Lamanna | 273/80.1 |

*Primary Examiner*—William H. Grieb

*Assistant Examiner*—Sebastiano Passaniti

*Attorney, Agent, or Firm*—Wallace J. Nelson

[57] ABSTRACT

An apparatus and process are disclosed for releasably attaching golf club heads, and particularly putter heads, to a golf shaft to permit easy interchange thereof. A golf putter 10 (FIGS. 1 and 2) including an elongated shaft 11, a hand grip 13 on one end, and an opening 15 at the other end thereof, is disclosed. A hollow insert 17 is fixedly attached (via adhesive bonding, soldering, or the like) within the open end 15 of shaft 11. The interior open area of insert 17 has a cross-sectional area in the form of a square, hexagon, octagon, keyway, or other angular surface shape and serves to receive a shank 19 of putter head 20 therein. The angular exterior surface of shank 19 is the male counterpart of the female opening of insert 17 and is adapted to snugly fit therein. Screws 25, 27 are threadedly inserted through transverse spaced bores formed through the club shaft 11, insert 17 and shank 19 to releasably attach putter head 20 to shaft 11. Interchanging of different putter heads involves only removal of screws 25, 27, removing the old putter head, inserting a new putter head within the insert and replacing screws 25, 27. In the embodiment of FIG. 10 a rod section 105 is attached to a putter head hosel 102 to provide the shank for attachment to shafts of the type shown in the other embodiments.

12 Claims, 2 Drawing Sheets

GOLF CLUB AND ASSEMBLY PROCESS

FIELD OF THE INVENTION

This invention relates generally to golf club assembly and relates specifically to apparatus and process for releasably securing golf putter heads to a shaft for selective interchange of the putter head and shaft, as so desired.

BACKGROUND OF THE INVENTION

Golf is one of the most popular sports that can be enjoyed by an individual. As in all individual sports, the equipment used must be compatible with the individual and he must be comfortable with the equipment chosen. Most serious golfers, and probably all professional golfers own more than one putter and, depending upon the feel of the practice green, may select a different putter for different courses or for the same course on different days. Presently, in order to change putters, it is necessary to buy an entire club including shaft and head. The new putter may have the desired head but differences in the new shaft and new grip may make it awkward for the golfer to quickly adjust to the new club. If it were possible to just change the putter head, the golfer would not have to also adjust to a new shaft and new grip.

The present invention serves to alleviate this problem. It is therefore an object of the present invention to provide an apparatus and process for interchanging putter heads on a golf shaft.

Another object of the present invention is a novel connection system for releasably attaching a golf club head to a shaft.

A further object of the present invention is a process for custom fitting a putter to an individual golfer.

An additional object of the present invention is a novel releasably attached putter head and golf shaft assembly

SUMMARY OF THE INVENTION

According to one aspect of the present invention the foregoing and additional objects are attained by providing a golf shaft having a hand grip surface along one end length portion thereof and a hollow opening at the opposite end. An insert having a hollow internal cross-sectional area in the form of a square, hexagon, octagon, keyway or other angular surface is attached to the interior open end of the hollow shaft. The insert is bonded, soldered or otherwise conventionally secured to the hollow interior of the shaft. One or more tapped openings are provided transversely through the hollow shaft and insert. A plurality of diverse size, shape and weight putter heads are provided, each having a putter face and a shank portion extending therefrom. The shank portion is formed integral with the putter head or, when the putter head is designed with a hosel end, may be a rod extension secured within the hosel end of the putter head. The external surface area of at least the terminal length portion of the shank is provided with an angular exterior surface area having a cross section in the shape of a square, hexagonal, octagonal, keyed or other angular area that mates with the internal surface of the insert disposed within the shaft. One or more tapped openings are provided transversely through the angular sided shank such that they align with the tapped openings in the hollow shaft and insert when the shank is positioned within the insert. A shoulder is provided at the base of the shank to engage the hollow club shaft and thereby assist in aligning the tapped openings on the shaft, insert and shank. Suitable screws are then threadingly positioned in these tapped openings to transversely extend through the hollow shaft, insert and club head shank, and thereby releasably attach the club head to the shaft. When it is desired to change putters, the screws are removed to permit release of the putter head and a different putter head installed by repeating the above described procedure.

BRIEF DESCRIPTION OF THE DRAWINGS

A more complete appreciation of the invention and many of the attendant advantages thereof will be more readily appreciated as the same becomes better understood by reference to the following detailed description when considered in connection with the accompanying drawings wherein.

DETAILED DESCRIPTION

Figure 1:
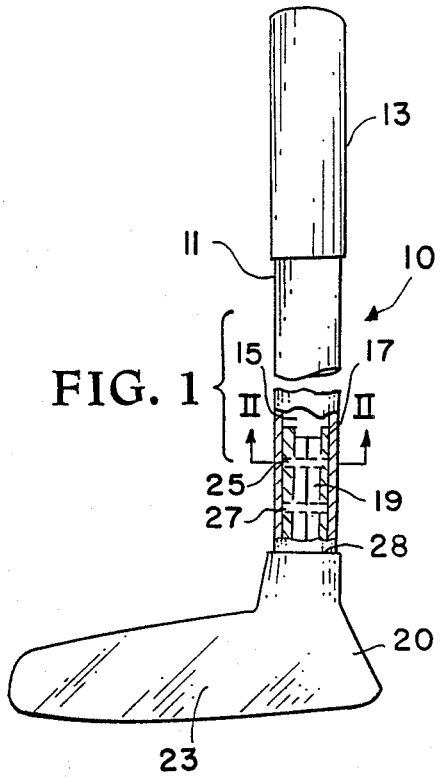
FIG. 1 is a broken, part sectional, part schematic, view of an exemplary golf putter constructed in accordance with the present invention.
Figure 2:
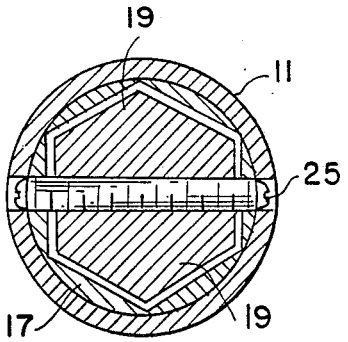
FIG. 2 is a view of the golf putter shown in FIG. 1 and taken along line II—II thereof.

Referring now to the drawings and more particularly to FIGS. 1 and 2, there is shown a golf putter constructed in accordance with the present invention and designated generally by reference numeral 10. Golf putter 10 includes an elongated shaft 11 having a hand grip 13 at one end and a hollow opening 15 at the other end. A hollow insert 17 is fixedly attached in the open end 15 of shaft 11. The exterior surface area of insert 17 conforms to the shape of the interior of shaft 11. The interior open area of insert 17 has a cross sectional area in the form of a square, hexagon, octagon, keyway or other angular surface shape. In FIG. 1 the interior open area of insert 17 has a cross-sectional area in the shape of a hexagon to receive the male hexagonal shank 19 of golf putter head 20. Putter head 20 is also provided with a ball engaging face 23. A pair of screws 25,27 extend transversely through shaft 11, insert 17, and shank 19 to releasably attach club head 20 to shaft 11. Drilled and tapped holes are provided in each of shaft 11, insert 17 and shank 19 to provide a tight fit for screws 25 and 27 and prevent accidental "backing out" thereof. The length of screws 25,27 are designed such that the screw ends are essentially flush with the exterior surface of shaft 11 when installed therethrough.

A shoulder 28 is provided on putter head 20, where reduced diameter shank 19 extends therefrom, and serves to engage the surface of open end 15 of shaft 11. The insertion of shank 19 into shaft 11 until shoulder 28 comes in contact therewith ensures that the tapped openings for screws 25,27 in shank 19 are in proper alignment with the tapped openings in shaft 11 and insert 17, and facilitates assembly of putter 10.

Insert 17, in the preferred embodiment, is formed of aluminum. Other lightweight metals or alloys, composites, hard plastics and the like, may be employed to form insert 17, as so desired. The attachment of insert 17 to the interior open end 15 of shaft 11 may be accomplished by soldering, adhesively bonding, or other conventional manner, with the attachment material or process depending upon the materials used for constructing shaft 11 and insert 17. When aluminum is used for shaft 11 and insert 17, soldering is the preferred attachment medium. With a composite shaft 11 and vinyl insert 17, epoxy adhesive is preferable as the attachment for the insert.

Referring now more particularly to FGG 3, a sectional view of a modified form for the insert is shown and designated by reference numeral 35. As shown therein, insert 35 is formed of a plastics material, such for example polyvinyl chloride, and is provided with an octagonal interior cross-sectional area. A pair of oppositely disposed tapped openings **37,37*a* are illustrated for receiving screws similar to those shown in FIGS. 1 and 2**.

Figure 7:
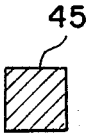
FIG. 7 is a sectional view of the putter shank taken along line VII—VII of FIG. 4.
Figure 4:
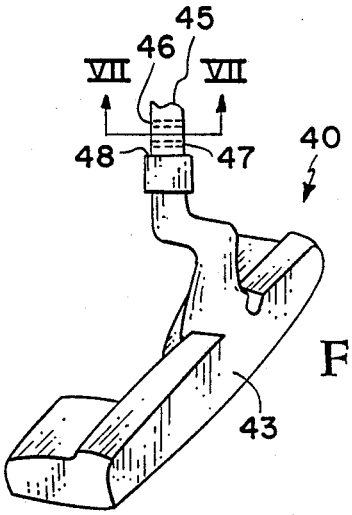
FIG. 4 is a view of a modified putter head similar to that shown in FIG. 1.

In FIG. 4 a different type putter head from that illustrated in FIG. 1, is shown and designated generally by reference numeral 40. As shown therein, putter head 40 has a ball engaging face 43 and a reduced diameter shank 45 offset or extending from an "L" or right angle extension from the putter body portion. Putter head 40 also differs from putter head 20 shown in FIG. 1 in that shank 45 is provided with a square cross-sectional area. The cross sectional view of shank 45, taken along line VII—VII, is illustrated in FIG. 7. When employing this putter head, an insert having a square female cross-sectional area would be employed. Shank 45 is also provided with two tapped openings transversely therethrough, as designated by reference numerals 46,47. A shoulder 48 is provided on putter head 40 and serves to limit the distance shank 45 may be positioned within the shaft insert and to ensure that tapped openings 46,47 are aligned with similar tapped openings provided transversely through the shaft and insert receiving male shank 45.

Figure 5:
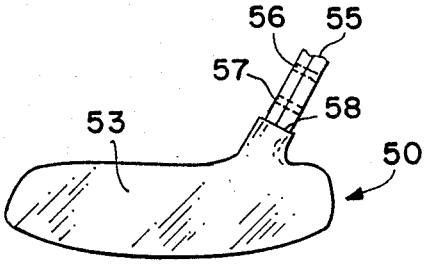
FIG. 5 is a view of a different putter head for use in the shaft shown in FIG. 1.

Referring now to FIG. 5, a different shape putter head is shown and designated generally by reference numeral 50. In this embodiment, putter head 50 has a ball engaging face 53 and a reduced diameter shank 55. Shank 55 is angled away from the ball engaging face area 53 and is provided with a pair of transverse tapped openings therethrough, as designated by reference numerals 56,57. As in the previously described embodiments, a shoulder 58 is provided on putter head 50 where the reduced diameter shank 55 portion ends and serves to limit the distance shank 55 may be received within the golf shaft and insert. Shank 55 has a hexagonal cross sectional area, as illustrated in the embodiment of FIGS. 1 and 2.

Figure 3:
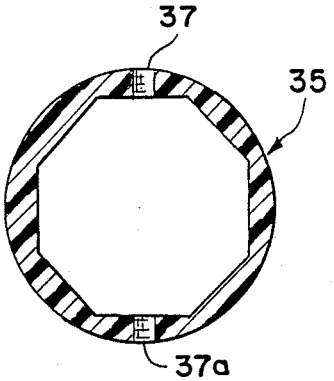
FIG. 3 is a view of a modified shaft insert for the putter shown in FIG. 1.
Figure 6:
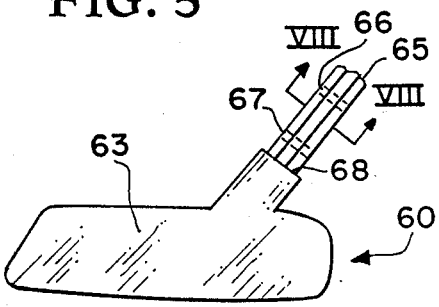
FIG. 6 is a view of another type putter head having a shank designed for the insert shown in FIG. 3.
Figure 8:
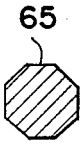
FIG. 8 is a sectional view of the putter shank taken along line VIII—VIII of FIG. 5.

Referring now to FIG. 6, another type putter head is illustrated and generally designated by reference numeral 60 A ball engaging face 63 is provided on putter head 63 and a reduced diameter shank 65 extends angularly from the top and adjacent an end of ball engaging face 63. Shank 65 has an octagonal cross-sectional area as illustrated by the view taken along line VIII—VIII and shown in FIG. 8. This shank is designed to be received within an insert of the shape shown in FIG. 3 and designated by reference numeral 35. A pair of transverse tapped openings 66,67 are provided spaced along the length of shank 65 to be aligned with tapped openings **37,37*a* (FIG. 3) of insert 35, and similar tapped openings (not designated) provided in the golf shaft. Shoulder 68 at the base of reduced diameter shank 65 is adapted to contact the end of the golf shaft having insert 35 fixed therein. This shoulder-to-shaft contact ensures that tapped openings 66, 67 align with tapped openings 37,37*a* and the others, not shown, of the golf shaft when putter head 60** is to be attached thereto.

Figure 9:
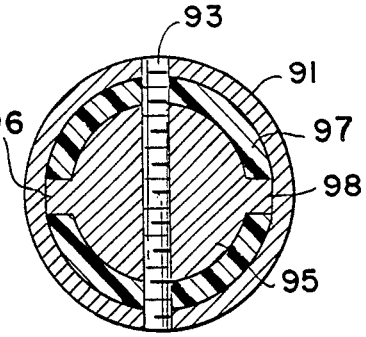
FIG. 9 is a sectional view of a putter shank/shaft assembly employing a keyed fit between the shaft insert and putter shank.

Referring now more particularly to FIG. 9, a sectional view of a modified putter head shank 95 is shown installed in a hollow insert 97 bonded to the interior of shaft 91. Insert 97 is provided with diametrically opposed keyways, not designated, to receive key extensions 96,98 of shank 95 leading from a suitable putter head. Suitable screws or bolts, one of which is shown and designated by reference numeral 93 threadingly extend through tapped openings provided in shaft 91, insert 97 and shank 95. Shank 95 may be formed on any suitable putter head, not shown.

Figure 10:
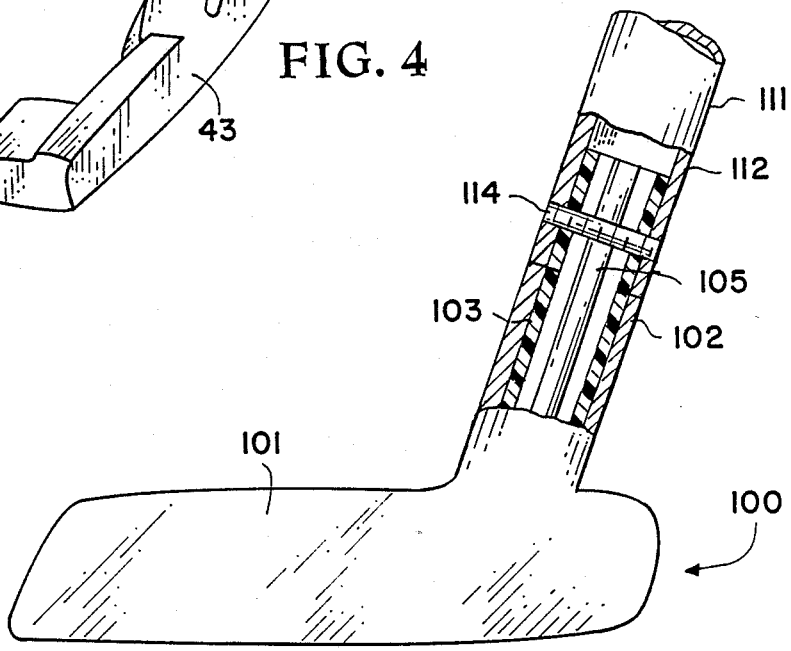
FIG. 10 is another embodiment of the present invention wherein a putter head hosel is provided with an insert and angular surfaced shank extension.

Referring now to FIG. 10, an exemplary putter head 100 having a ball engaging face 101 and an elongated hosel 102 is shown. To attach this type of putter head, according to the present invention, a first hollow insert 103 is bonded to the interior of hosel 102. Hollow insert 103 has an interior cross-sectional surface area in the form of a hexagon, octagon, square, keyway(s) or other angular surface and serves to matingly receive a short rod section 105 therein. Rod section 105 is provided with an exterior surface that mates with the interior surface of hollow insert 103 and is attached thereto in non-rotative position by suitable adhesive or other conventional attachment means. An end of rod section 105 extends from hosel 102 and serves as a shank to connect with club shaft 111 as in the previously described embodiments. More specifically, a second hollow insert 112 is bonded within the open end of shaft 111 to mate with and receive rod section 105. As in the previously described embodiments, one or more screws, one of which is shown and designated by reference numeral 114, are provided extending transversely through tapped openings (not designated) provided through shaft 111, insert 112 and rod element 105 to assist in releasably retaining putter head 100 on shaft 111. Rod element 105 and the inserts 103 and 112 may be formed of any mating cross-sectional area as that described hereinbefore for the other embodiments or formed of any other cross-sectional area that prevents relative rotation between the parts.

The putter heads 20, 40, 50, 60 and 100 are intended as exemplary examples of the numerous putter head shapes that are available on the market and are shown herein merely to illustrate the invention and are not to be deemed as exhaustive. Also, each putter head shank or hosel shown in the specific examples is not limited to the putter head shape illustrated therewith, and may be used in combination with any of the putter head shapes shown herein, or on any putter heads that are otherwise available.

It is thus seen that the present invention fulfills a definite need in the art and the operation and process for utilizing the invention are believed apparent from the above detailed description. When a golfer desires a new putter he is no longer limited to off-the-shelf items that may not exactly suit his taste or satisfy his need. Instead, he may visit a pro-shop where the local club pro determines the shaft length and weight suited for the customer and lets the customer select the grip, as well as, the style and design of the putter head he likes best. The specific insert(s) and rod elements (FIG. 10) may be factory installed or installed by the local pro and the putter head selection may be made from a variety of models available at the pro shop. After selection, the putter head is attached to the shaft by one or more transverse screws, as described hereinbefore, and the customer proceeds to the practice putting surface or green. If the first head and shaft are not comfortable to the customer, he may change either and practice until he finds the exact combination to his liking. If he likes more than one putter head he need only purchase one shaft and can change putter heads when so desired. Also, even if only one putter head is purchased, the option of coming back and purchasing different components at a later date is always open. In some instances it may also be necessary to trim the club shaft to obtain the desired length. Similarly, by utilizing bushings and different lengths of the rod element 105 shown in FIG. 10, club shafts may be lengthened.

The invention appears particularly advantageous to the professional golfer, or others, that play in competition on different courses. The interchangeable putter heads permit the competitive golfer, professional or otherwise, to evaluate different heads or shafts according to how the greens on a particular course are playing that day. Once a specific putter head and shaft are selected, the other heads are left at the club house, either in a locker or vehicle, to avoid any possible violation of the rule specifying the number of clubs that may be carried while participating in a golf tournament or match.

Although the invention has been described relative to specific embodiments thereof, it is not so limited and numerous variations and modifications thereof will be readily apparent to those skilled in the art in the light of the above teachings.

Also, the invention has been described specifically toward interchangeable putter heads, it is not so limited and can be employed to custom design any club that is to be used.

It is therefore to be understood that, within the scope of the appended claims, the invention may be practiced other than as specifically described.

What is claimed as new and desired to be secured by Letters Patent of the United States is:

1. In combination, a golf club shaft having a hand grip at one end and a hollow opening at the other end thereof and a golf putter head having a ball engaging face and a shank extending therefrom adapted to be inserted within the hollow open end of said shaft, the improvement therewith comprising:

a hollow insert fixed within at least a portion of the hollow open end of said shaft, said hollow insert having an exterior surface conforming to the internal surface area of the open end of said shaft and an internal surface having female cross-sectional angular surfaced areas thereon, said shank having an external male cross-sectional angular surface that mates with an snugly engages the female cross-sectional angular surface areas of said hollow insert when said shank is inserted into said hollow insert, at least one axially aligned transverse tapped opening in each of said shaft, said insert and said shank, a screw threadingly received through each said at least one axially aligned transverse tapped opening in said hollow shaft, said hollow insert and said shank to releasably attach said putter head to said hollow club shaft and, facilitate selective changing of putter heads on said hollow club shaft.

2. The combination of claim 1 wherein said golf putter head includes an open hosel end, a rod section fixedly positioned within said hosel end and extending therefrom to form said shank, an additional hollow insert means releasably disposed within said hosel end and matingly receiving said rod section.

3. The combination of claim 1 including a shoulder surface on said golf putter head where said shank extends therefrom, said shoulder surface serving to engage the hollow end of said golf club shaft when said shank is received within said insert to thereby determine the maximum length of said shank disposed within said shaft and wherein said hollow insert is confined to and fixedly attached within the open end of said shaft.

4. The combination of claim 1 wherein said female cross-sectional angular surface areas of said hollow insert form an open square configuration and the external cross-sectional surface of said shank is a mating square configuration.

5. The combination of claim 1 wherein said female cross-sectional angular surface areas of said hollow insert form an octagonal configuration and the external cross-sectional surface area of said shank is a mating octagonal configuration.

6. The combination of claim 1 wherein said female cross-sectional angular surface areas of said hollow insert form a hexagonal configuration and the external cross-sectional surface area of said shank is a mating hexagonal configuration.

7. The combination of claim 1 wherein said female cross-sectional angular surface areas of said hollow insert form keyway slots therein and the external cross-sectional surface area of said shank is provided with mating key portions received by said keyway slots.

8. The combination of claim 1 wherein a shoulder is provided on said putter head where said shank portion extends therefrom, said shoulder serving to engage the hollow end of said shaft and thereby limit the distance said shank may enter said shaft and further serving to assist in aligning said tapped openings in said hollow shaft, said insert and said shank, and wherein said at least one axially aligned transverse tapped opening comprises a pair of spaced tapped openings and wherein a pair of screw members are received, one each, in said pair of spaced tapped openings.

9. A golf putter assembly comprising a shaft and a putter head, said shaft having a hand grip surface are adjacent one end thereof and provided with an internal tubular opening at the other end thereof;

a hollow insert secured within at least a portion of the internal tubular opening of said shaft;

said putter head having a face for engaging a golf ball and a shank portion extending from said face and received by said hollow insert secured within the tubular opening in said shaft;

said hollow insert and said shank having angular mating surfaces that prevent relative rotation therebetween when said shank is disposed within said insert;

a pair of screw members disposed in spaced relationship along the tubular open end of said shaft and transversely received through the internal tubular opening of said shaft, said insert and said shank to releasably connect said putter head to said shaft, said shaft, said hollow insert and said shank being provided with transverse tapped openings therethrough to receive said pair of screw members, and said screw members having ends essentially flush with the exterior surface of said shaft when installed in said tapped openings.

10. A method for releasably connecting a golf putter head to a golf club shaft comprising:

providing a golf club shaft having a hand grip at one end and a hollow opening at the other end thereof;

attaching a hollow insert within the open end of the shaft;

providing at least one tapped hole transversely through the shaft and hollow insert, providing a golf putter head having a ball engaging face surface and an elongated shank extending therefrom;

providing at least one tapped hole transversely through the elongated shank;

providing mating angular surfaces on the hollow insert and the elongated shank to prevent relative rotation therebetween when the shank is received by the insert;

positioning the shank within the insert so that the at least one tapped hole in the shaft and insert is aligned with the at least one tapped hole in the elongated shank;

aligning the at least one tapped hole extending transversely through each of the hollow open end of the shaft, insert and elongated shank, and, releasably attaching the shank within the insert by threadingly inserting a screw through the aligned at least one tapped hole in the shaft, insert and shank such that the screw ends are essentially flush with the exterior surface of said shaft.

11. The method of claim 10 wherein the at least one tapped hole provided in the shaft, insert and shank comprises a pair of spaced holes with each member of the pair being aligned and the step of releasably attaching the shank within the insert includes threadingly inserting a screw in each of the pair of spaced holes.

12. The method of claim 10 wherein the elongated shank extending from the golf putter is a rod section releasably secured within an open end hosel of the golf putter head.

* * * * *